US008876503B2

(12) United States Patent
Cho et al.

(10) Patent No.: US 8,876,503 B2
(45) Date of Patent: Nov. 4, 2014

(54) SCROLL COMPRESSOR WITH SHAFT INSERTING PORTION AND MANUFACTURING METHOD THEREOF

(71) Applicants: Namkyu Cho, Seoul (KR); Cheolhwan Kim, Seoul (KR); Kangwook Lee, Seoul (KR); Byeongchul Lee, Seoul (KR)

(72) Inventors: Namkyu Cho, Seoul (KR); Cheolhwan Kim, Seoul (KR); Kangwook Lee, Seoul (KR); Byeongchul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 92 days.

(21) Appl. No.: 13/733,797

(22) Filed: Jan. 3, 2013

(65) Prior Publication Data

US 2013/0216415 A1 Aug. 22, 2013

(30) Foreign Application Priority Data

Jan. 4, 2012 (KR) ..... 10-2012-0001122

(51) Int. Cl.

| | |
|---|---|
| ***B23P 15/00*** | (2006.01) |
| ***F04C 18/00*** | (2006.01) |
| ***F04C 15/00*** | (2006.01) |
| ***F04C 23/00*** | (2006.01) |
| ***F04C 18/02*** | (2006.01) |

(52) U.S. Cl.

CPC ..... *F04C 18/00* (2013.01); *F04C 2230/60* (2013.01); *F04C 15/0076* (2013.01); *F04C 23/008* (2013.01); *F04C 18/0215* (2013.01)

USPC ..... 418/55.3; 418/55.1; 29/888.022

(58) Field of Classification Search

CPC ..... F04C 18/0215; F04C 15/0076; F04C 23/008; F04C 2730/60; F04C 18/00

USPC ..... 418/55.1–55.6; 29/888.022

See application file for complete search history.

(56) References Cited

U.S. PATENT DOCUMENTS

| | | | | |
|---|---|---|---|---|
| 6,752,607 | B2 * | 6/2004 | Kiem et al. | 418/55.5 |
| 7,150,609 | B2 * | 12/2006 | Kiem et al. | 418/55.5 |
| 7,273,361 | B2 * | 9/2007 | Park | 418/55.1 |
| 7,281,914 | B2 * | 10/2007 | Lee | 418/60 |
| 7,726,020 | B2 * | 6/2010 | Ebara et al. | 29/888.022 |

* cited by examiner

*Primary Examiner* — Hoang Nguyen

(74) *Attorney, Agent, or Firm* — KED & Associates LLP

(57) ABSTRACT

A scroll compressor having a rotational shaft insertion hole and a fabrication method thereof are provided. The scroll compressor includes a casing; a fixed scroll fixed to an inner wall surface of the casing; an orbiting scroll combined with the fixed scroll to form a compression chamber while performing an orbiting movement with respect to the fixed scroll; a rotational shaft having a shaft portion inserted into the fixed scroll, an eccentric portion that penetrates the fixed scroll to be combined with the orbiting scroll, and a neck portion having a diameter less than a diameter of the eccentric portion to connect the eccentric portion to the shaft portion, wherein the shaft portion, the eccentric portion, and the neck portion are integrally formed; a fixed bush interposed between the fixed scroll and the shaft portion; and a driving unit configured to drive the rotational shaft. A neck portion insertion hole, into which the neck portion is inserted, and a shaft portion insertion hole, into which the shaft portion is movably inserted in a transverse direction, are formed at the fixed scroll, and the fixed bush restricts a transverse directional movement of the shaft portion to maintain a state in which an outer circumferential portion of the neck portion insertion hole is inserted into the neck portion.

16 Claims, 9 Drawing Sheets

SCROLL COMPRESSOR WITH SHAFT INSERTING PORTION AND MANUFACTURING METHOD THEREOF

CROSS-REFERENCE TO RELATED APPLICATIONS

The present disclosure relates to subject matter contained in priority Korean Application No. 10-2012-0001122, filed on Jan. 4, 2012, which is herein expressly incorporated by reference in its entirety.

BACKGROUND OF THE INVENTION

1. Field of the Invention

The present disclosure relates to a scroll compressor having a rotation shaft insertion hole and a fabrication method thereof, and more particularly, to a scroll compressor in a form that part of the rotation shaft is inserted into a fixed scroll in a penetrating manner and a fabrication method thereof.

2. Description of the Related Art

Scroll compressor may include a fixed scroll having a fixed wrap and a circulating scroll having a circulating wrap, which is a compressor in the form of inhaling and compressing refrigerant through a continuous volume change of the compression chamber formed between the fixed wrap and the circulating wrap while the circulating scroll performs a circulating movement on the fixed scroll. The scroll compressor continuously performs inhalation, compression and discharge, and thus has excellent characteristics in the aspect of vibration and noise generated during its operational process compared to other types of compressors.

On the other hand, the circulating scroll is typically formed with a disk shaped end plate and the circulating wrap at the side of the end plate. Furthermore, a boss portion is formed at a rear surface on which the circulating wrap is not formed and connected to a rotation shaft for circulating the circulating scroll. Such a shape may form a circulating wrap over a substantially overall area of the end plate, thereby decreasing a diameter of the end plate portion for obtaining the same compression ratio. However, on the contrary, the operating point to which a repulsive force of refrigerant is applied and the operating point to which a reaction force for cancelling out the repulsive force is applied are separated from each other in the vertical direction during compression, thereby causing a problem of increasing vibration or noise while the circulating scroll is tilted during the operational process.

As a method for solving such problems, there has been disclosed a scroll compressor in the form that a position at which the rotation shaft and the circulating scroll are combined with each other is formed on the same surface as the circulating wrap. In such a type of compressor, the operating point of a repulsive force and the operating point of the reaction force are applied at the same position, thereby solving a problem that the circulating scroll is inclined. However, when the rotation shaft is extended up to the circulating wrap in this manner, an end portion of the rotation shaft should pass through the end plate portion, and thus a shaft insertion hole should be formed at the end plate portion of the circulating scroll to the extent corresponding to the diameter of the rotation shaft. Due to this, there has been a problem of deteriorating a strength of the end plate portion. Moreover, as increasing the diameter of the shaft insertion hole formed at the end plate portion, the possibility of leaking compressed refrigerant is increased.

In order to solve the foregoing problem, as disclosed in Korean Patent Application No. 10-2011-0046492, there has been used a scheme in which a pin portion having a small diameter is formed at an end portion of the rotation shaft, and only the pin portion passes through the end plate portion of the circulating scroll, and an eccentric bush is inserted into the pin portion to form an eccentric portion. Through this, the diameter of the shaft insertion hole formed at the circulating scroll can be reduced, but a compression force may be applied to the pin portion having a small diameter, thereby reducing the strength as well as causing deformation due to this. Moreover, a processing deviation between the eccentric bush and pin portion may cause abrasion between the eccentric bush and pin portion when they are used for a long period of time, thereby deteriorating the bearing performance.

SUMMARY OF THE INVENTION

The present disclosure is contrived to overcome the foregoing drawbacks in the related art, and a technical task of the present disclosure is to provide a scroll compressor capable of allowing the rotation shaft to be stably combined therewith as well as enhancing the strength and reliability.

Furthermore, another technical task of the present disclosure is to provide a method of fabricating the foregoing scroll compressor.

In order to accomplish the foregoing technical task, according to an aspect of the present disclosure, there is provided a scroll compressor including a casing; a fixed scroll fixed to an inner wall surface of the casing; a circulating scroll combined with the fixed scroll to form a compression chamber while performing a circulating movement against the fixed scroll; a rotation shaft in which a shaft portion inserted into the fixed scroll, an eccentric portion penetrating the fixed scroll to be combined with the circulating scroll, and a neck portion having a diameter less than that of the eccentric portion to connect the eccentric portion to the shaft portion are integrally formed; a fixed bush interposed between the fixed scroll and the shaft portion; and a driving unit configured to drive the rotation shaft, wherein a neck portion insertion hole into which the neck portion is inserted and a shaft portion insertion hole into which the shaft portion is movably inserted in the transverse direction are formed at the fixed scroll, and the fixed bush restricts the transverse directional movement of the shaft portion to maintain a state that an outer circumferential portion of the neck portion insertion hole is inserted into the neck portion.

According to the foregoing aspect of the present disclosure, the rotation shaft integrally formed with the eccentric portion can be inserted into the fixed scroll using a fixed bush interposed between the fixed scroll and the rotation shaft even in the state that the size of the insertion hole formed at the fixed scroll is minimized. In other words, the rotation shaft is initially inserted thereinto in the state that the fixed bush is not inserted thereinto to insert the incorporated eccentric portion into an inner portion of the fixed scroll, and then the fixed bush is inserted thereinto to fix the rotation shaft not to be released therefrom.

Here, the center of the eccentric portion and the center of the neck portion may be disposed to be crossed to each other. Furthermore, an outer circumferential surface of the eccentric portion and an outer circumferential surface of the neck portion may be disposed on a straight line in part. Through this, it may be possible to minimize the size of the insertion hole that should be formed at the fixed scroll.

Specifically, a neck portion insertion hole into which the neck portion is inserted and disposed concentrically to the shaft portion may be formed on the fixed scroll, and the neck portion may be eccentrically disposed at an inner portion of the neck portion insertion hole. Here, the neck portion insertion hole may be disposed concentrically to the shaft portion, thereby further increasing the available compression space. At this time, part of the neck portion may be disposed to be brought into contact with an inner wall of the neck portion insertion hole.

On the other hand, a slide bearing may be interposed between the fixed bush and the shaft portion, and a lubricant surface may be provided at an inner surface of the fixed bush, thereby allowing the fixed bush itself to be functioned as a bearing.

According to another aspect of the present disclosure, there is provided a scroll compressor including a rotation shaft comprising a shaft portion combined with a driving unit, a neck portion concentrically provided at one side end portion of the shaft portion to have a diameter less than the shaft portion, and an eccentric portion eccentrically provided at an end portion of the neck portion to have a diameter less than that of the shaft portion but greater than that of the neck portion; a fixed scroll formed with a neck portion insertion hole through which the eccentric portion passes and a shaft portion insertion hole into which the shaft portion is movably inserted in the transverse direction; a circulating scroll combined with the eccentric portion to perform a circulating movement against the fixed scroll; and a fixed bush into which the shaft portion insertion hole is inserted and to an inner portion of which the shaft portion is rotatably fixed.

According to the foregoing aspect of the present disclosure, the rotation shaft may move in the transverse direction within the shaft portion insertion hole, and thus the rotation shaft integrated with the eccentric portion may be provided to pass through the fixed scroll even when the neck portion insertion hole is formed with only a size to the extent that the eccentric portion can pass through the neck portion insertion hole.

Here, part of the bottom surface of the eccentric portion may be disposed at an outer side of the neck portion insertion hole, thereby increasing a contact area between a bottom surface of the eccentric portion and an upper surface of the fixed scroll as well as enhancing the airtightness.

According to still another aspect of the present disclosure, there is provided a method of fabricating a scroll compressor comprising a rotation shaft comprising a shaft portion combined with a driving unit, a neck portion concentrically provided at one side end portion of the shaft portion to have a diameter less than the shaft portion, and an eccentric portion eccentrically provided at an end portion of the neck portion to have a diameter less than that of the shaft portion but greater than that of the neck portion; a fixed scroll formed with a neck portion insertion hole through which the eccentric portion passes and a shaft portion insertion hole into which the shaft portion is movably inserted in the transverse direction; a circulating scroll combined with the eccentric portion to perform a circulating movement against the fixed scroll; and a fixed bush into which the shaft portion insertion hole is inserted and to an inner portion of which the shaft portion is rotatably fixed, and the method may include inserting the eccentric portion into the neck portion insertion hole in a penetrating manner; moving the rotation shaft such that the inserted eccentric portion is eccentrically disposed within the neck portion insertion hole; and inserting the fixed bush into an inner portion of the shaft portion insertion hole.

According to yet still another aspect of the present disclosure, there is provided method of fabricating a scroll compressor comprising a driving unit, a rotation shaft rotatably driven by the driving unit, a fixed scroll having a shaft portion insertion hole into which the rotation shaft is inserted and a circulating scroll combined with the rotation shaft to perform a circulating movement against the fixed scroll, and the method may include inserting the rotation shaft into an inner portion of the fixed scroll; moving the rotation shaft to one side thereof along an end plate of the fixed scroll; and inserting a fixed bush into the shaft portion insertion hole to reduce a gap between the shaft portion insertion hole and the rotation shaft.

According to aspects of the present disclosure having the foregoing configuration, the rotation shaft integrated with the eccentric portion can be inserted into the fixed scroll using the fixed bush interposed between the fixed scroll and the rotation shaft even in the state that the size of the insertion hole formed at the fixed scroll is minimized. Through this, it may be possible to prevent a strength of the end plate portion of the fixed scroll from being deteriorated and prevent the airtightness thereof from being deteriorated.

Furthermore, the size of the insertion hole formed at the fixed scroll may be minimized to increase an available compression space that can be used on the fixed scroll, and due to this, it may be possible to obtain a higher compression ratio even without increasing the outer dimension of the compressor.

Furthermore, an outer circumferential surface of the eccentric portion and an outer circumferential surface of the neck portion may be disposed on a straight line in part, thereby further minimizing the size of the insertion hole that should be formed at the fixed scroll.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a scroll compressor according to an embodiment of the present disclosure will be described in detail with reference to the accompanying drawings.

Figure 1:
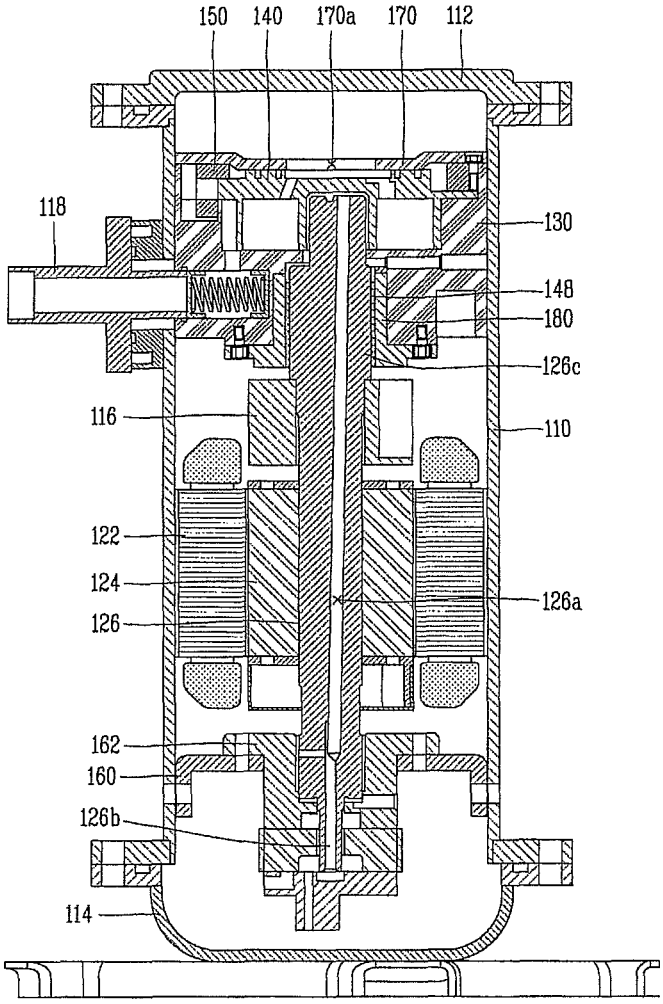
FIG. 1 is a cross-sectional view illustrating the internal structure of a scroll compressor according to an embodiment of the present disclosure.
Figure 2:
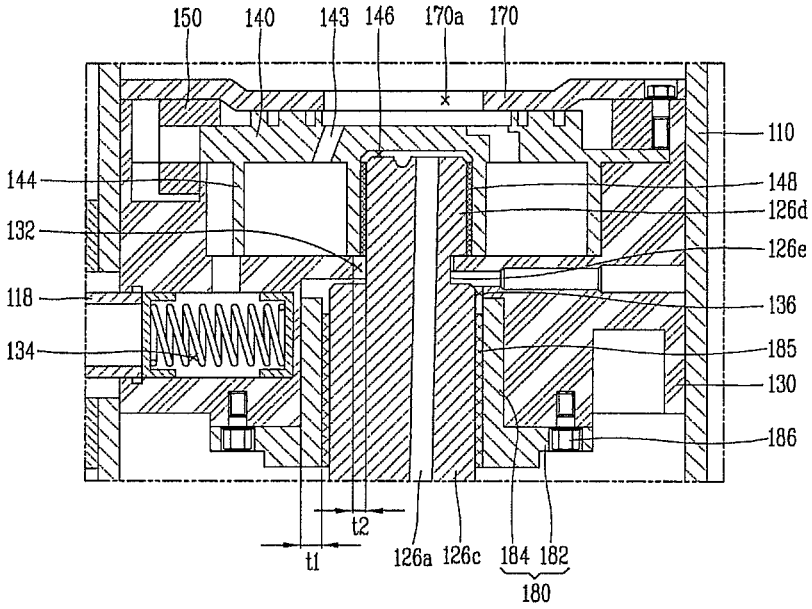
FIG. 2 is an enlarged cross-sectional view illustrating a region adjacent to the eccentric portion in FIG. 1.
Figure 3:
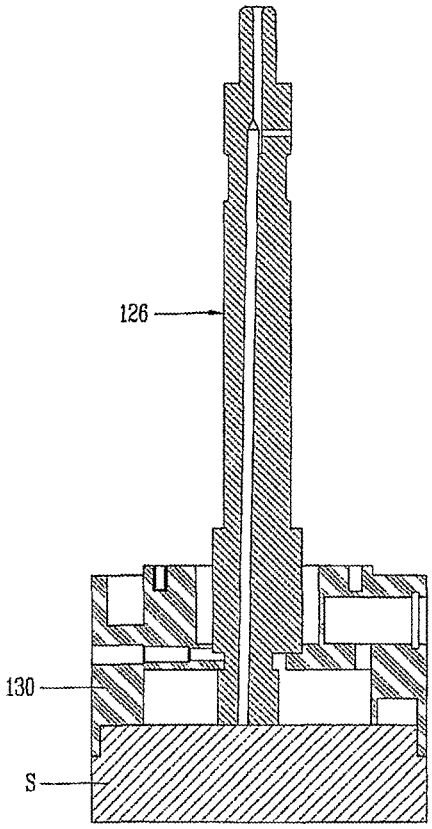
FIGS. 3 through 9 are cross-sectional views illustrating a fabrication process of the foregoing embodiment.

FIG. 1 is a cross-sectional view illustrating the internal structure of a scroll compressor according to an embodiment of the present disclosure, and FIG. 2 is an enlarged cross-sectional view illustrating a region adjacent to the eccentric portion in FIG. 1. Referring to FIGS. 1 and 2, a scroll compressor according to the present embodiment has a cylindrically shaped casing 110, and an upper shell 112 and a lower shell 114 for covering an upper portion and a lower portion of the casing, respectively. The upper shell and lower shell may be bonded to the casing to form one confined space together with the casing. Moreover, the lower shell 114 may also function as an oil chamber for storing oil supplied to operate the compressor in an efficient manner.

Furthermore, a suction pipe 118 is provided at a lateral surface of the casing 110. As a path through which refrigerant to be compressed flows, the suction pipe 118 is disposed to communicate with a suction port 134 formed at the fixed scroll 130 which will be described later as illustrated in FIG. 1.

A motor 120 as a driving unit may be provided at a substantially central portion of the inner portion of the casing 110. The motor 120 may include a stator 122 fixed to an inner surface of the casing 110 and a rotor 124 located at an inner portion of the stator 122 to be rotated by an interaction with the stator 122. A rotation shaft 126 is combined with the center of the rotor 124, and thus the discharge circuit 124 and rotation shaft 126 are rotated at the same time.

An oil passage 126*a* may be formed at an central portion of the rotation shaft 126 to be extended along a length direction of the rotation shaft 126, and an oil pump 126*b* for supplying oil stored in the lower shell 114 to the upper portion thereof may be provided at a lower end portion of the rotation shaft 126. The oil pump 126*b* may have a shape in which a spiral groove is formed or a separate impeller is provided at an inner portion of the oil passage, and a separate capacity type pump may be provided therein.

A shaft portion 126*c* inserted into an inner portion of the shaft portion insertion hole 136 formed on the fixed scroll 130 is disposed at an upper end portion of the rotation shaft 126. A neck portion 126*e* having a diameter less than the shaft portion is integrally formed at an end portion of the shaft portion. An eccentric portion 126*d* is integrally formed at an end portion of the neck portion 126*e*, and referring to FIG. 2, the eccentric portion 126*d* is located eccentrically to the neck portion 126*e*.

Specifically, the neck portion 126*e* is located eccentrically to the shaft portion 126*c*, and the eccentric portion 126*d* is also located eccentrically to the neck portion. Here, an eccentric amount of the eccentric portion 126*d* to the neck portion 126*e* may be set similarly to a diameter difference between the neck portion and eccentric portion. Due to this, the eccentric portion 126*d* and neck portion 126*e* are disposed on a straight line to each other in part (left end portion in FIG. 2). Meanwhile, the neck portion may be concentrically disposed to the shaft portion.

The fixed scroll 130 may be mounted within the casing 110. An outer circumferential surface of the fixed scroll 130 may be pushed and fixed to an inner wall of the casing 110 in a shrink fit manner or combined therewith by welding.

A shaft portion insertion hole 136 into which the shaft portion of the foregoing rotation shaft 126 is inserted is formed at a bottom surface of the fixed scroll 130. Here, an inner diameter of the shaft portion insertion hole 136 is formed to be greater than an outer diameter of the shaft portion 126*c*, and thus the shaft portion 126*c* can move in the transverse direction (left and right direction in FIG. 2) of the compressor within the shaft portion insertion hole 136. The movement of the shaft portion 126*c* is obstructed by the fixed bush 180 inserted and fixed to an inner wall of the shaft portion insertion hole 136.

The fixed bush 180 may include a flange 182 in contact with a bottom surface of the fixed scroll 130 and a bush portion 184 to which the shaft portion 126*c* is fixed to an inner portion thereof. Furthermore, the flange 182 is bolt-fastened to the fixed scroll 130, and thus the fixed bush 180 is fixed to the fixed scroll 130. In other words, the fixed bush 180 is fixed to the fixed scroll in a detachable manner. Moreover, a slide bearing 185 allowing the shaft portion to be efficiently rotated within the bush portion is provided within the bush portion 184. Here, an example in which the slide bearing 185 may be omitted and an inner surface of the bush portion becomes a lubricant surface may be taken into consideration.

A neck portion insertion hole 132 in which the neck portion 126*e* is eccentrically disposed is formed at an upper portion of the shaft portion insertion hole 136. The neck portion insertion hole 132 is formed to penetrate the fixed scroll 130, thereby allowing the eccentric portion 126*d* to pass therethrough to the side of the circulating scroll which will be described later. Here, an inner diameter of the neck portion insertion hole 132 is formed to be slightly greater than an outer diameter of the eccentric portion 126*d*, thereby allowing the eccentric portion to pass therethrough. Moreover, the neck portion insertion hole 132 is disposed concentrically to the shaft portion. Of course, an example in which the neck portion insertion hole is located eccentrically to the shaft portion may be taken into consideration, but in this case, an area in which the fixed wrap can be formed on the fixed scroll may be reduced. It means the reduction of an area that can be used as a compression space, thus resulting in the deterioration of the compression ratio.

On the other hand, in the form illustrated in FIG. 2, an outer circumferential portion of the neck portion insertion hole is inserted into the neck portion, thereby disallowing the eccentric portion to pass through an inner portion of the neck portion insertion hole in the longitudinal direction. Accordingly, in order to allow the eccentric portion to pass through an inner portion of the neck portion insertion hole, the shaft portion 126*c* should be moved in the left direction in FIG. 2, thereby eliminating an interference between an outer circumferential portion of the neck portion insertion hole and the neck portion. Accordingly, the thickness (t1) of the bush portion 184 is formed to be greater than a gap (t2) between the neck portion insertion hole 132 and the neck portion. Due to this, the transverse directional movement of the shaft portion is allowed, and as a result, the passage of the eccentric portion is enabled.

When there is no fixed bush, the neck portion insertion hole should be further extended compared to the illustration of FIG. 2. In other words, the right side of the neck portion insertion hole should be extended to an outer side of the eccentric portion in FIG. 2, thereby deteriorating the strength of the end plate portion of the fixed scroll and the airtightness thereof. Moreover, as described above, the compression ratio may be reduced since the effective compression space is decreased as increasing the neck portion insertion hole, but according to the present embodiment, the neck portion insertion hole may be reduced through the attachment and detachment of the fixed bush. Meanwhile, a circulating scroll 140 is provided at an upper portion of the fixed scroll 130. The circulating scroll 140 is formed with a substantially circular shaped end plate portion 142 and a circulating wrap 144 combined with the fixed wrap 136. Furthermore, a substantially circular shaped eccentric portion combining portion 146 to which the eccentric portion 126*d* is rotatably inserted and fixed is formed at a central portion of the end plate portion 142. An outer circumferential portion of the eccentric portion combining portion 146 is connected to the circulating wrap, thereby performing the role of forming a compression chamber along with the fixed wrap during the compression process. Furthermore, a slide bearing 148 is provided at an inner wall of the eccentric portion combining portion 146, and similarly to the fixed scroll, an example in which the slide bearing may be removed and a lubricant surface is provided at an inner wall of the eccentric portion combining portion may be taken into consideration.

On the other hand, the eccentric portion 126*d* is rotatably inserted into the eccentric portion combining portion 146, and thus the neck portion 126*e* of the rotation shaft 126 is inserted into an end plate portion of the fixed scroll in a penetrating manner, and the circulating wrap, fixed wrap, and eccentric portion 126*d* are provided to be overlapped in the lateral direction of the compressor. During compression, a repulsive force of refrigerant is applied to the fixed wrap and circulating wrap, and a compression force is applied between the eccentric portion combining portion and the eccentric portion 126*d* as a reaction force thereto. As described above, when part of the shaft is overlapped with the wrap in a radial direction through the end plate portion, the repulsive force and compression force of refrigerant are applied to the same surface based on the end plate, and thus they are cancelled out by each other. Due to this, it may be possible to prevent the inclination of the circulating scroll by the operation of the compression force and repulsive force. Furthermore, a discharge hole 143 is formed on the end plate portion 142 and thus compressed refrigerant may be discharged to an inner portion of the casing. The location of the discharge hole may be set at discretion by taking a required discharge pressure or the like into consideration.

Furthermore, an oldham ring 150 for preventing the rotation of the circulating scroll is provided at an upper side of the circulating scroll 140. The oldham ring 150 is key-combined between the circulating scroll 140 and fixed scroll 130, thereby preventing the circulating scroll from being rotated against the fixed scroll.

On the other hand, a lower bearing 162 for rotatably supporting a lower side of the rotation shaft 126 is provided at a lower portion of the casing 110, and a lower frame 160 for supporting the lower bearing 162 is fixed to an inner wall of the casing 110. Furthermore, an upper frame 170 for supporting the circulating scroll and the oldham ring 150, respectively, is provided at an upper portion of the circulating scroll. A hole 170*a* communicated with a discharge hole of the circulating scroll 140 to discharge compressed refrigerant to the side of the upper shell is formed at the center of the ice bank 170.

Moreover, a balance weight 116 for preventing vibration due to the circulating movement of the circulating scroll is fixed to the shaft portion and rotated along with the shaft portion.

Hereinafter, a fabrication process of the foregoing embodiment will be described with reference to FIGS. 3 through 9.

First, the rotation shaft 126 is inserted into the neck portion insertion hole 132 in the state that the fixed scroll 130 is reversely fixed to a jig (S). At this time, the rotation shaft 126 is inserted in an eccentric state to the right side in FIG. 3, and the eccentric portion passes through the neck portion insertion hole, and then moves to the left side and thus assembled into the configuration illustrated in FIG. 3.

Figure 4:
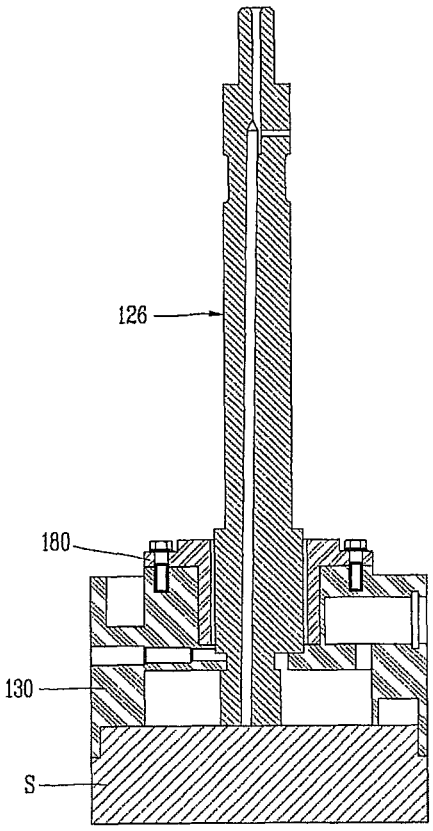
Figure 5:
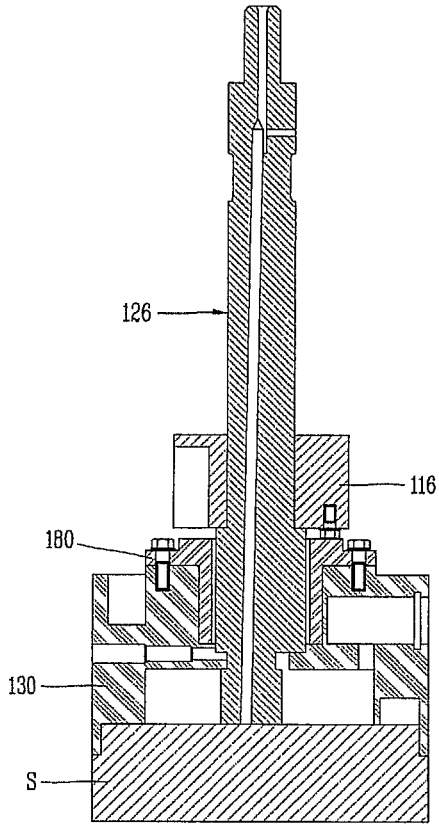

Then, as illustrated in FIG. 4, the fixed bush 180 is fixed to the shaft portion insertion hole, thereby preventing the rotation shaft from being moved in the left and right direction to be stably fixed thereto.

Figure 6:
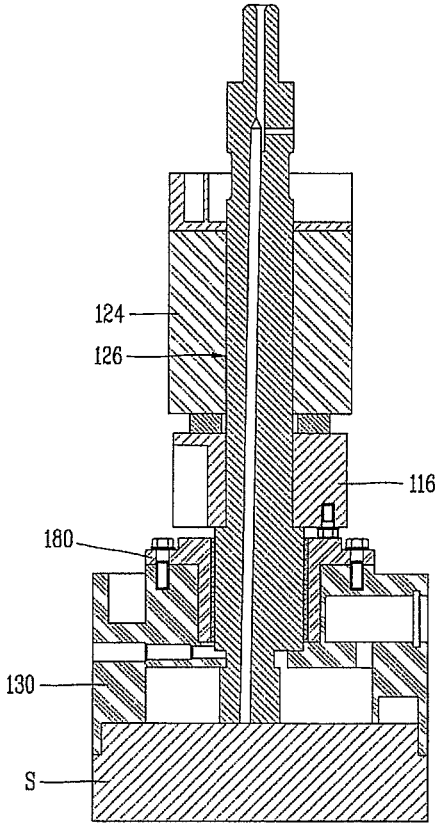
Figure 7:
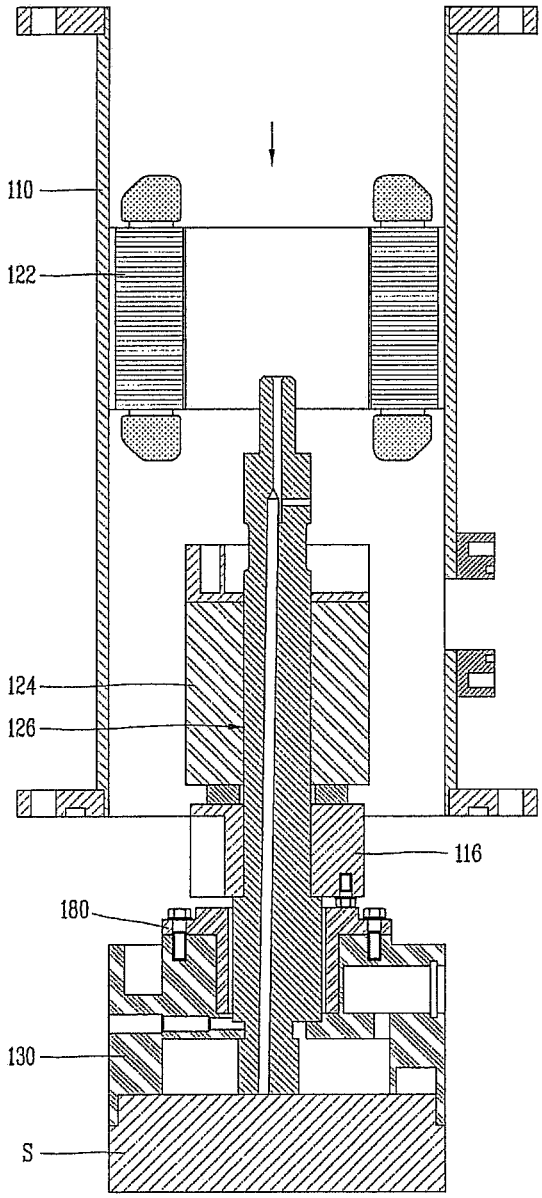

Next, the balance weight 116 is fixed to the rotation shaft 126 (FIG. 5), and subsequently the rotor 124 is fixed to the rotation shaft 126 (FIG. 6). Then, the casing 110 is fixed to the fixed scroll. The balance weight 116 is combined with an outer circumferential surface of the fixed scroll in a shrink fit manner, and the combination with the fixed scroll is made in the state that the refrigerating chamber 122 is fixed to an inner wall of the casing 110 in advance (FIG. 7).

Figure 8:
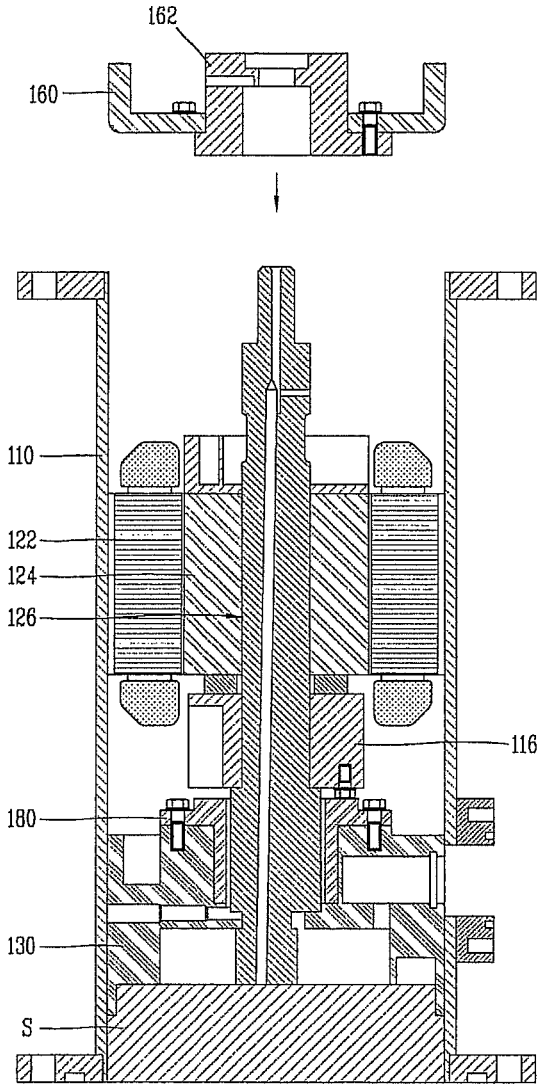

Then, the lower bearing and lower frame are fixed to an upper end portion of the rotation shaft 126. The lower bearing is also fixed to the rotation shaft in the state of being fixed to the lower frame, and the lower frame is fixed to an inner wall of the casing 110 in a shrink fit manner (FIGS. 8 and 9).

Figure 9:
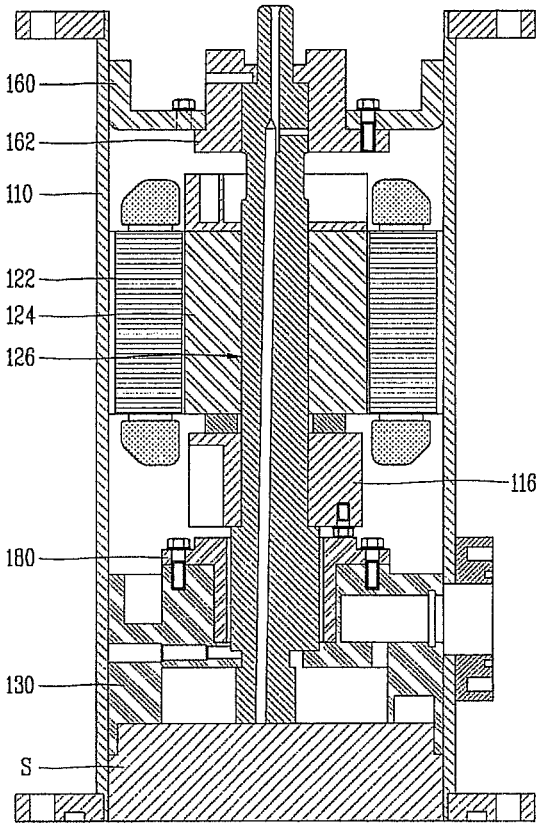

In the configuration illustrated in FIG. 9, a lower shell is welded and fixed to an upper end portion of the casing, and the jig is removed, and then the upper shell is welded and fixed thereto, thereby finishing the embodiment in the form illustrated in FIG. 1.

What is claimed is:

1. A scroll compressor, comprising:

a casing;

a fixed scroll fixed to an inner wall surface of the casing;

an orbiting scroll combined with the fixed scroll to form a compression chamber while performing an orbiting movement with respect to the fixed scroll;

a rotational shaft comprising a shaft portion inserted into the fixed scroll, an eccentric portion that penetrates the fixed scroll to be combined with the orbiting scroll, and a neck portion having a diameter less than a diameter of the eccentric portion, that connects the eccentric portion to the shaft portion, wherein the shaft portion, the eccentric portion, and the neck portion are integrally formed;

a fixed bush interposed between the fixed scroll and the shaft portion; and a driving unit configured to drive the rotational shaft, wherein a neck portion insertion hole, into which the neck portion is inserted, and a shaft portion insertion hole, into which the shaft portion is movably inserted in a transverse direction, are formed at the fixed scroll, and wherein the fixed bush restricts a transverse directional movement of the shaft portion to maintain a state in which an outer circumferential portion of the neck portion insertion hole is inserted into the neck portion.

2. The scroll compressor of claim 1, wherein a center of the eccentric portion and a center of the neck portion are disposed to be crossed to each other.

3. The scroll compressor of claim 2, wherein an outer circumferential surface of the eccentric portion and an outer circumferential surface of the neck portion are disposed on a straight line in part.

4. The scroll compressor of claim 1, wherein the neck portion insertion hole is disposed concentrically to the shaft portion, and the neck portion is eccentrically disposed at an inner portion of the neck portion insertion hole.

5. The scroll compressor of claim 4, wherein a portion of the neck portion is disposed to be brought into contact with an inner wall of the neck portion insertion hole.

6. The scroll compressor of claim 1, wherein a slide bearing is interposed between the fixed bush and the shaft portion.

7. The scroll compressor of claim 1, wherein a lubricant surface is provided at an inner surface of the fixed bush.

8. A scroll compressor, comprising:

a rotational shaft comprising a shaft portion combined with a driving unit, a neck portion concentrically provided at one side end portion of the shaft portion to have a diameter less than a diameter of the shaft portion, and an eccentric portion eccentrically provided at an end portion of the neck portion to have a diameter less than the diameter of the shaft portion but greater than a diameter of the neck portion;

a fixed scroll formed with a neck portion insertion hole, through which the eccentric portion passes, and a shaft portion insertion hole, into which the shaft portion is movably inserted in a transverse direction;

an orbiting scroll combined with the eccentric portion to perform an orbiting movement with respect to the fixed scroll; and a fixed bush, into which the shaft portion insertion hole is inserted and to an inner portion of which the shaft portion is rotatably fixed.

9. The scroll compressor of claim 8, wherein a thickness of the fixed bush is formed to be greater than a depth of the neck portion.

10. The scroll compressor of claim 8, wherein a portion of a bottom surface of the eccentric portion is disposed at an outer side of the neck portion insertion hole.

11. The scroll compressor of claim 8, wherein the neck portion is eccentrically disposed at an inner portion of the neck portion insertion hole.

12. The scroll compressor of claim 11, wherein a portion of the neck portion is disposed to be brought into contact with an inner wall of the neck portion insertion hole.

13. The scroll compressor of claim 8, wherein a slide bearing is interposed between the fixed bush and the shaft portion.

14. The scroll compressor of claim 8, wherein a lubricant surface is provided at an inner surface of the fixed bush.

15. A method of fabricating a scroll compressor comprising a rotational shaft comprising a shaft portion combined with a driving unit, a neck portion concentrically provided at one side end portion of the shaft portion to have a diameter less than a diameter of the shaft portion, and an eccentric portion eccentrically provided at an end portion of the neck portion to have a diameter less than the diameter of the shaft portion but greater than a diameter of the neck portion; a fixed scroll formed with a neck portion insertion hole, through which the eccentric portion passes, and a shaft portion insertion hole, into which the shaft portion is movably inserted in a transverse direction; an orbiting scroll combined with the eccentric portion to perform an orbiting movement with respect to the fixed scroll; and a fixed bush, into which the shaft portion insertion hole is inserted and to an inner portion of which the shaft portion is rotatably fixed, the method comprising:

inserting the eccentric portion into the neck portion insertion hole in a penetrating manner;

moving the rotational shaft such that the inserted eccentric portion is eccentrically disposed within the neck portion insertion hole; and inserting the fixed bush into an inner portion of the shaft portion insertion hole.

16. A method of fabricating a scroll compressor comprising a driving unit, a rotational shaft rotatably driven by the driving unit, a fixed scroll having a shaft portion insertion hole, into which the rotational shaft is inserted, and an orbiting scroll combined with the rotational shaft to perform an orbiting movement against the fixed scroll, the method comprising:

inserting the rotational shaft into an inner portion of the fixed scroll;

moving the rotational shaft to one side thereof along an end plate of the fixed scroll; and inserting a fixed bush into the shaft portion insertion hole to reduce a gap between the shaft portion insertion hole and the rotational shaft.

* * * * *